US005724052A

United States Patent [19]

Boulingre et al.

[11] Patent Number: 5,724,052

[45] Date of Patent: Mar. 3, 1998

[54] DEVICE FOR REDUCING THE RADOME EFFECT WITH A SURFACE-RADIATING WIDEBAND ANTENNA AND REDUCING THE RADAR CROSS SECTION OF THE ASSEMBLY

[75] Inventors: Christian Boulingre, Le Plessis Robinson; Henri Perron, Bagnolet; Jean Rannou, Antony, all of France

[73] Assignee: Thomson-CSF, Puteaux, France

[21] Appl. No.: 364,674

[22] Filed: May 16, 1989

[30] Foreign Application Priority Data

Jun. 14, 1988 [FR] France ..... 88 07905

[51] Int. Cl.[6] ..... H01Q 1/42

[52] U.S. Cl. ..... 343/872

[58] Field of Search ..... 342/1, 2, 4; 343/872, 343/873, 910, 911 R

[56] References Cited

U.S. PATENT DOCUMENTS 3,233,238 2/1966 Barker .
3,430,245 2/1969 Wolcott ..... 343/872
3,942,180 3/1976 Rannou et al. .
3,945,016 3/1976 Bizouard et al. .
4,387,122 6/1983 Rannou et al. .

*Primary Examiner*—Theodore M. Blum
*Attorney, Agent, or Firm*—Pollock, Vande Sande & Priddy

[57] ABSTRACT

A layer (30) absorbing transmitted radiation, placed between an antenna (10) and a radome (20) and extending parallel to the surface of the antenna at a close distance thereto, the absorption coefficient of said absorbing layer varying between a minimum value in the center of the radiating surface and a maximum value at the periphery of said radiating surface.

The absorbing layer may in particular be formed by a central area (31) with a zero or virtually zero absorption coefficient surrounded by a peripheral area (32) with a constant absorption coefficient. It may also be formed by a succession of concentric areas exhibiting respective absorption coefficients increasing from the center to the periphery.

In addition to the reduction of the radome effect, said structure reduces significantly the radar cross section of the assembly when the latter is the target of a radar.

12 Claims, 2 Drawing Sheets

DEVICE FOR REDUCING THE RADOME EFFECT WITH A SURFACE-RADIATING WIDEBAND ANTENNA AND REDUCING THE RADAR CROSS SECTION OF THE ASSEMBLY

BACKGROUND OF THE INVENTION

1. Field of the Invention

The present invention relates to a device for reducing the disturbing effect produced by the reflections of waves on a radome protecting a surface-radiating wideband antenna, and for reducing the radar cross section of the assembly.

2. Description of the Prior Art

As a matter of fact, with these antennas (that are commonly used for countermeasures), it is well known that the radome disturbs the radiation pattern of the antenna it protects.

This disturbing phenomenon is the more significant as the wall of the radome is thick and the operating frequencies are high.

Now, it must be possible, and it is often necessary, to have relatively thick radomes capable of withstanding rain erosion, hydrostatic pressure, etc., as the case may be, without too much impairing the performance of the antenna, in particular at high frequencies.

FIG. 1 illustrates this disturbing phenomenon due to the wave reflections on the radome.

The reference numeral 10 denotes the antenna, which is of the type with essentially surface radiation and which is on this drawing a flat antenna, although other shapes could be envisaged as well (cylindrical antenna, spherical antenna, etc.).

In addition, at the frequencies of interest, it will be assumed that the propagation of the waves is a propagation of the optical or quasi-optical type.

An incident ray OR1 coming from a point O of the antenna will go through the radome 20 at the point 21, but a portion of its energy will be reflected in the air/radome interface at this point. The reflected ray, reflected in the direction of the antenna, will again be reflected at the point 11 on the surface of the antenna 10, thus giving rise to a new incident ray R2 that will go through the radome but with a partial reflection in the radome/air interface at the point 22, that will be followed, as previously, by a further reflection on the antenna at the point 12, and so on.

Due to this process, in addition to the transmission loss inherent to the presence of the radome (a loss that depends on the material and the thickness of the radome), there will be an additional disturbance due to interferences between the main ray R1 and the parasitic ray R2 and the other rays produced by the successive multiple reflections, all phase-shifted relative to R1; these interferences will result in significant irregularities of the radiation pattern of the antenna, these irregularities being the more significant as the wall of the radome is thick and the working frequencies are high.

When the bandwidths are very wide ($f_{max}/f_{min}$ ratios>10) and the working frequencies are high ($f_{max}$ of about 20 GHz), if the minimum thickness of the radome is higher than 1 mm, it is virtually impossible to achieve a reflection coefficient lower than 0.2 for the radome even if an optimized structure (multilayer radome, sandwich radome) is used for the latter to reduce the reflection coefficient without reducing too much the transmission coefficient.

Thus if it is desired to radiate, for example, in the 2–20-GHz = band, the apparent area of the antenna in the case of a spiral antenna, for example, is given by the Formula $S_a=(\lambda_{max}/\pi)^2\pi$, where $\lambda_{max}/\pi$ is the diameter of the radiating area at the lowest frequency; for $f_{min}$=2 GHz, we thus have $S_a$=71 cm$^2$.

This figure will be compared with the equivalent area at the highest frequency given by $S_e=\lambda_{min}^2(G/4\pi)$, that is $S_e$=0.36 cm$^2$ for an antenna gain G of 3 dB at 20 GHz.

We thus have $S_a/S_e$=200, so that with the prior art configuration shown in FIG. 1, the energy reflected by the radome will be almost entirely reflected again by the antenna since the peripheral surface, not active at the highest frequencies, will be seen as a reflecting plane extending to infinity by the active central portion.

SUMMARY OF THE INVENTION

A purpose of the present invention is accordingly to minimize this phenomenon and consequently to allow the use of relatively thick radomes without impairing the performance at the highest frequencies and without having recourse to complex structures for the radome.

To solve this problem, the present invention is based on the observed fact that in the surface-radiating wideband antennas generally used (spiral antennas, log-periodic antennas and similar antennas), the radiating areas are essentially located toward the center for the highest frequencies and essentially toward the periphery for the lowest frequencies.

Taking into account this property, the present invention proposes to place between the radome and the antenna a lossy dielectric that acts in a selective manner between the center and the periphery.

More precisely, there is provided a layer for absorbing the transmitted radiation, placed between the antenna and the radome and extending parallel to the surface of the antenna at a close distance thereto, the absorption coefficient of this absorbing layer varying between a minimum value at the center of the radiating surface and a maximum value at the periphery of this radiating surface.

According to a number of advantageous embodiments, said minimum value may be a zero or virtually zero value; the absorbing layer may in particular be formed by a central area with a zero or virtually zero absorption coefficient surrounded by a peripheral area with a constant absorption coefficient, and the central area may in particular be formed by a hollow in the absorbing layer.

The absorbing layer may also be formed by a succession of concentric areas exhibiting respective absorption coefficients increasing from the center to the periphery.

As to the materials to be used, the absorbing layer may be a dielectric layer including carbon particles dispersed in a cellular material; or it may also be a layer including a ferromagnetic material; in this case, the thickness of the layer including the ferromagnetic material being chosen so as to correspond, taking into account the permittivity and the magnetic permeability of the ferromagnetic material, to the resonance or to the vicinity of the resonance at the frequency at which the maximum absorption effect is desired.

BRIEF DESCRIPTION OF THE DRAWINGS

Other features and advantages of the present invention will become apparent from a consideration of the following detailed description of preferred embodiments given as a non-limitative example with reference to the accompanying drawings, in which.

DESCRIPTION OF THE PREFERRED EMBODIMENTS

Figure 1:
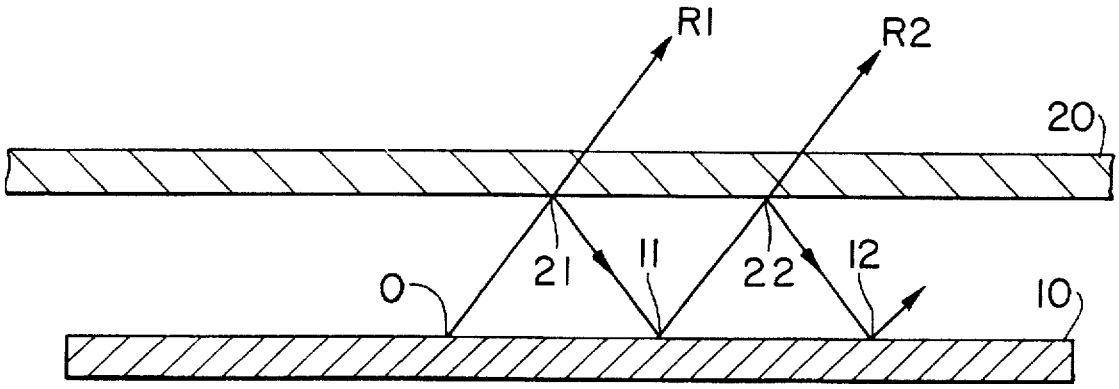
FIG. 1 PRIOR ART
FIG. 1, already mentioned, illustrates the effect of the radome as it occurs in the prior art structures.
Figure 2:
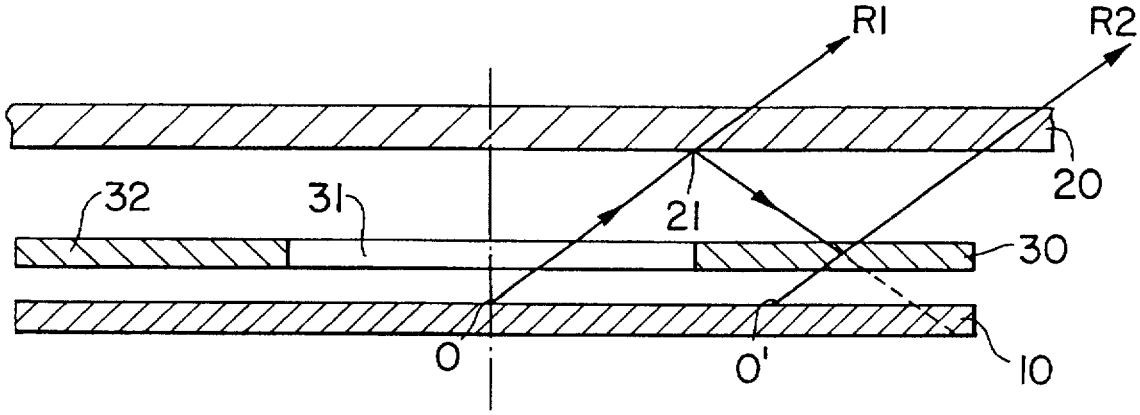
FIG. 2 shows a first embodiment of the present invention.
Figure 3:
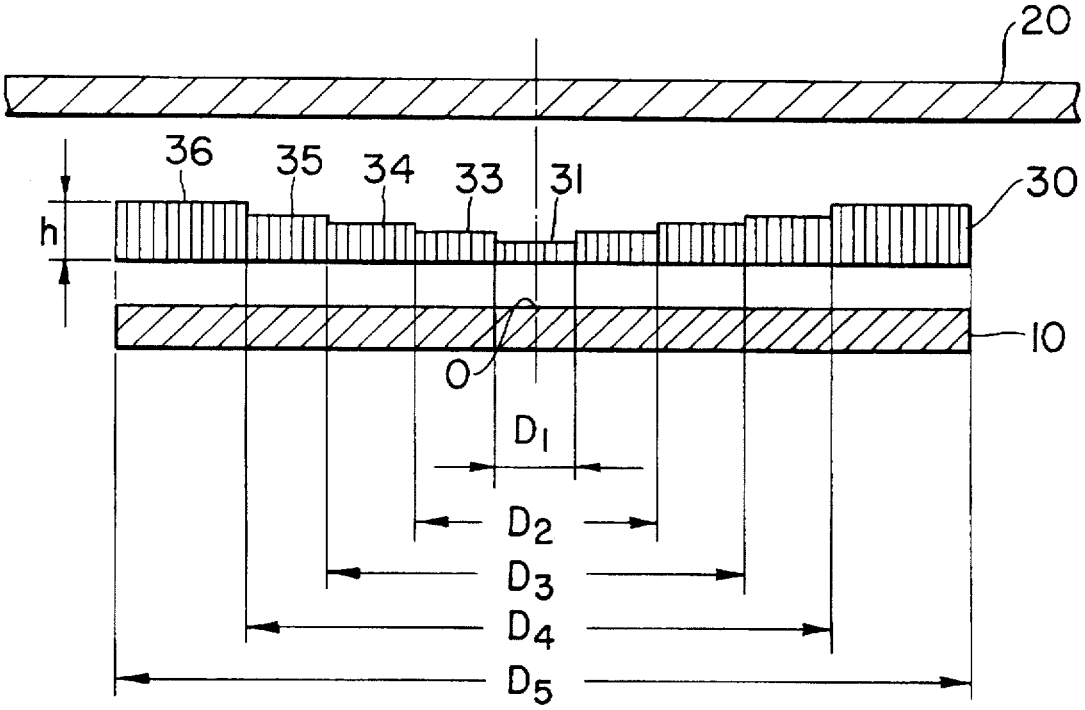
FIGS. 3 and 4 are sectional views of an antenna-radome assembly showing a second embodiment of the present invention, respectively according to two possible variants.
Figure 4:
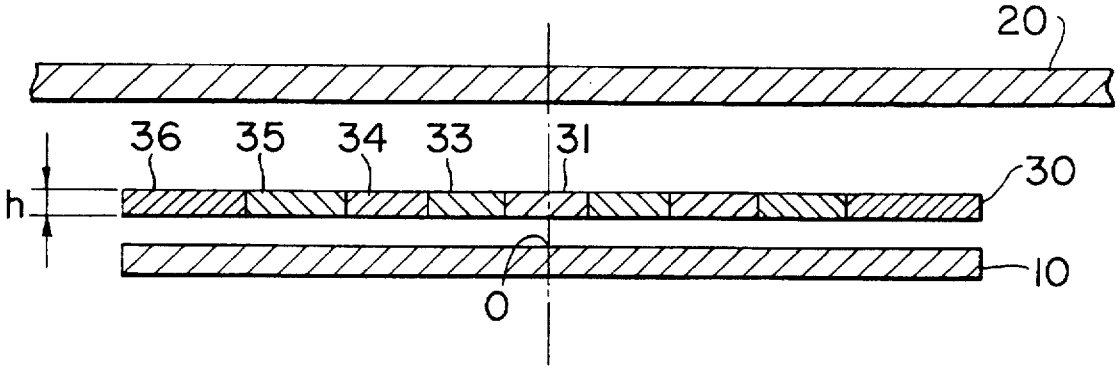

In FIGS. 2 to 4, the reference numerals 10 and 20 denote respectively, as in FIG. 1, the antenna and the radome that protects it.

In a manner characteristic of the present invention, there has been placed, parallel to the plane of the antenna and at a short distance therefrom, an absorbing layer 30 whose attenuation is not the same in the center and at the periphery.

By "short distance" it will be understood a distance between the antenna and the absorbing layer as short as possible but nevertheless sufficient not to substantially affect the propagation of the currents in the antenna.

In the case of FIG. 2, which is the simplest case, the absorbing layer 30 is a uniform layer exhibiting a central hole 31 so as to leave only a ring 32 covering the peripheral portion of the antenna 10.

In this way, as it is known that absorbing materials, in a general manner, exhibit a transmission loss proportional to frequency, an absorbing material located over the peripheral portion of the antenna will have little effect on the energy radiated by the latter in this area corresponding to the lowest frequencies, this radiation being illustrated in FIG. 2, for example, by the ray R2 coming from the point O' located in the peripheral radiating area.

On the other hand, this material will exhibit a high attenuation for the highest frequencies. As these high frequencies radiate from the central area of the antenna (point O and radius R1 in FIG. 2), the waves radiated directly from this area are not attenuated due to the fact that the central area is facing the hole 31, but the reflected rays (for example the ray reflected at point 21) encounter the absorbing peripheral ring 32 and ace thus almost fully eliminated.

As a variant, there can be provided, as shown in FIGS. 3 and 4, a progressive increase of the absorption coefficient from the center to the periphery.

This variation is obtained, for example, by providing a plurality of concentric areas 31 to 36 with increasing diameters D1 to D5 and exhibiting an increasing absorption from the center to the periphery.

In FIG. 3, the absorption coefficient is varied by increasing the thickness h of the absorbing layer from the center to the periphery; conversely (FIG. 4) and with the same result, it is possible to use an absorbing material with an absorption coefficient varying with the diameter while the thickness h remains constant.

In any case, it is desirable to choose for the central area 31 a material or a thickness allowing the lowest possible absorption so as not to act on the high frequencies.

As to the material of the absorbing layer 30, it is possible to use, for example, a dielectric absorbent based on carbon dispersed in a cellular material.

The reflection coefficient of such a material is low, which permits attenuation without reflecting (as a matter of fact, if the material was reflecting, the phenomenon illustrated in FIG. 1 occurring between the antenna 10 and the radome 20 would occur again between the antenna 10 and the absorbing layer 30). However, such a type of absorbent requires relatively significant thicknesses up to 5 to 10 mm depending on the frequency band.

It is also possible to use an absorbent based on resin and powdered iron.

However, with this type of material, the absorbent/air interface exhibits a non-negligible reflection. To remedy this disadvantage, the characteristics of the material and the thickness of the absorbing layer are chosen so as to correspond to the resonance or to the vicinity of the resonance i.e., with an attenuation such that the energy reflected after a round trip in the absorbing layer be substantially equal to the energy reflected in the air/absorbent interface: the two waves being in phase opposition, the effect of the reflection is virtually cancelled.

This resonance condition is satisfied when the thickness e is chosen such that $e(\mu\epsilon)^{1/2}=\lambda/4$, where $\mu$ is the magnetic permeability and $\epsilon$ is the permittivity of the absorbent.

The advantage of this last type of absorbent is that it permits use of a small thickness, about 1 to 2 mm. Additionally, its absorption coefficient is of about 3 dB/mm at 10 GHz, and the attenuation of the energy reflected by the radome at high frequencies will be very significant.

Of course, although the present invention has been described for a flat antenna protected by a flat radome, this configuration is not limiting and the invention can as well be applied to a flat antenna protected by a cylindrical radome, a conical radome, an hemispheric radome or other radome, to a cylindrical antenna protected by a cylindrical radome, to a spherical antenna protected by a spherical radome, etc.

Furthermore, in addition to the fact that it permits considerable reduction in the radome effect, the structure according to the present invention has also the advantage of reducing in a significant manner the radar cross section of the antenna-radome assembly, thanks to which when such a structure is the target of a radar, its radar cross section as seen by the radar will be considerably reduced due to the absorbing layer that has been added.

What is claimed is:

1. A device for reducing the disturbing effect produced by the reflections of waves on a radome protecting a surface-radiating wideband antenna, and for reducing the radar cross section of the assembly, comprising a layer for absorbing transmitted radiation, placed between said antenna and said radome, and extending parallel to the surface of the antenna at a close distance to said antenna, said absorbing layer having an absorption coefficient varying between a minimum value in the center of the radiating surface of the antenna, and a maximum value at the periphery of said radiating surface.

2. A device according to claim 1, wherein said minimum value is substantially zero.

3. A device according to claim 2, wherein said absorbing layer is formed by a central area with a substantially zero absorption coefficient surrounded by a peripheral area having a constant absorption coefficient.

4. A device according to claim 3, wherein said central area is formed by a hollow in said absorbing layer.

5. A device according to claim 1, wherein said absorbing layer is formed by a succession of concentric areas having respective absorption coefficients having a value which increases from the center to the periphery.

6. A device according to any one of claims 1 to 5, wherein said absorbing layer is a dielectric layer including carbon particles dispersed in a cellular material.

7. A device according to any one of claims 1 to 5, wherein said absorbing layer is a layer including a ferromagnetic material.

8. A device according to claim 7, wherein the thickness of said layer including a ferromagnetic material is chosen based upon the permittivity and the magnetic permeability of said ferromagnetic material, with respect to the resonant frequency at which the maximum absorption effect is desired.

9. A device for suppressing reflections from an internal radome surface which protects a surface radiating wideband antenna transmitting radio frequency signals over a frequency bandwidth comprising:

a radio frequency absorbent material layer interposed between said internal radome surface and said antenna adjacent said antenna, said layer having an absorption coefficient which varies from a minimum value adjacent a portion of said antenna which transmits high frequency signals, to a maximum value adjacent portions of said antenna which transmits low frequency signals.

10. The device of claim 9 wherein said portion having a minimum absorption coefficient is adjacent a central portion of said antenna.

11. The device of claim 9 wherein said absorption coefficient is varied by varying the thickness of said absorbent material layer.

12. The device of claim 9 wherein said layer has a thickness which varies from a minimum value in the vicinity of a central axis of said radome to a maximum value at the periphery of said radome.

* * * * *